US009895589B2

(12) United States Patent
Papadopoulos

(10) Patent No.: US 9,895,589 B2
(45) **Date of Patent: *Feb. 20, 2018**

(54) LIGHT-WEIGHT PORTABLE BICYCLE ROLLERS

(71) Applicant: Larry C. Papadopoulos, North Plains, OR (US)

(72) Inventor: Larry C. Papadopoulos, North Plains, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/151,770

(22) Filed: May 11, 2016

(65) Prior Publication Data

US 2016/0250541 A1 Sep. 1, 2016

Related U.S. Application Data

(63) Continuation of application No. PCT/US2014/065370, filed on Nov. 13, 2014, which (Continued)

(51) Int. Cl.
*A63B 69/16* (2006.01)

(52) U.S. Cl.
CPC ..... *A63B 69/16* (2013.01); *A63B 2069/167* (2013.01); *A63B 2210/58* (2013.01); *A63B 2225/09* (2013.01)

(58) Field of Classification Search
CPC ... A63B 22/0605; A63B 22/02; A63B 21/225; A63B 69/16; A63B 2210/50; (Continued)

(56) References Cited

U.S. PATENT DOCUMENTS 581,835 A 5/1897 Sturgis
602,546 A 4/1898 Tarver
(Continued)

FOREIGN PATENT DOCUMENTS

EP 2319592 A1 5/2011
EP 2929917 A1 10/2015
(Continued)

OTHER PUBLICATIONS

Lloyd et ai, "The mechanical efficiency of treadmill running against a horizontal impeding force," J. Physiol., vol. 223, pp. 355-363 (1972).

(Continued)

*Primary Examiner* — Andrew S Lo
(74) *Attorney, Agent, or Firm* — Timothy E. Siegel Patent Law, PLLC; Timothy E. Siegel

(57) ABSTRACT

A bicycle rollers device (110), having a frame (112, 114, 116) that includes a rear mounting assembly (112) for two rear rollers; a front mounting assembly for a front roller (114); support elements (140, 141, 142, 144, 145) for supporting the frame above a surface, upon which the support elements are set to rest; and a central bridge (116) connecting the front mounting assembly to the rear mounting gear. Also, two rear rollers are mounted in the rear mounting assembly and a front roller is mounted in the front mounting assembly and defines a roller width. Finally, the central bridge is more narrow than the roller width, thereby permitting a bicycle rider to mount and dismount a bicycle set on the rollers without encountering the central bridge.

22 Claims, 6 Drawing Sheets

Related U.S. Application Data is a continuation-in-part of application No. 14/080,016, filed on Nov. 14, 2013, now Pat. No. 9,295,894.

(58) Field of Classification Search

CPC ..... A63B 2022/0652; A63B 22/06; A63B 21/015; A63B 2069/165; A63B 2022/0641; A63B 2071/025; A63B 23/0476; A63B 21/0421; A63B 21/0552

USPC ..... 482/51, 54, 57–66; D21/661–664

See application file for complete search history.

(56) References Cited

U.S. PATENT DOCUMENTS

| | | | |
|---|---|---|---|
| 604,200 | A | 5/1898 | Vogeler |
| 2,498,047 | A | 2/1950 | Myers |
| 2,623,302 | A | 12/1952 | Shields |
| 3,526,042 | A | 9/1970 | Nelson |
| 3,686,776 | A | 4/1972 | Dahl |
| 3,871,648 | A | 3/1975 | Mauer, III |
| 4,082,265 | A | 4/1978 | Berkes |
| 4,352,363 | A | 10/1982 | Wilson |
| 4,415,152 | A | 11/1983 | Smith |
| 4,580,983 | A | 4/1986 | Cassini et al. |
| 4,709,917 | A | 12/1987 | Yang |
| 4,750,737 | A | 6/1988 | Smith |
| 4,779,863 | A | 10/1988 | Yang |
| 4,802,666 | A | 2/1989 | Rodriqguez |
| 4,925,183 | A | 5/1990 | Kim |
| 4,932,651 | A | 6/1990 | Defaux |
| 4,958,832 | A | 9/1990 | Kim |
| 5,010,763 | A | 4/1991 | Schneider |
| 5,076,792 | A | 12/1991 | Niermann |
| 5,100,127 | A | 3/1992 | Melnick et al. |
| 5,205,800 | A | 4/1993 | Grant |
| 5,240,417 | A | 8/1993 | Smithson et al. |
| 5,314,391 | A | 5/1994 | Potash et al. |
| 5,364,271 | A | 11/1994 | Aknin et al. |
| 5,385,519 | A | 1/1995 | Hsu et al. |
| 5,492,516 | A | 2/1996 | Trotter |
| 5,662,559 | A | 9/1997 | Vasquez |
| 5,800,314 | A | 9/1998 | Sakakibara et al. |
| 5,919,119 | A | 7/1999 | Bohmer et al. |
| 6,004,243 | A | 12/1999 | Ewert |
| 6,056,672 | A | 5/2000 | Carbonell |
| 6,123,547 | A | 9/2000 | Teresi |
| 6,123,647 | A | 9/2000 | Mitchell |
| 6,126,571 | A | 10/2000 | Parks |
| 6,126,575 | A | 10/2000 | Wang |
| 6,135,924 | A | 10/2000 | Gibbs et al. |
| 6,394,239 | B1 | 5/2002 | Carlson |
| 6,416,444 | B1 | 7/2002 | Lim et al. |
| 6,447,424 | B1 | 9/2002 | Ashby et al. |
| 6,454,679 | B1 | 9/2002 | Radow |
| 6,500,098 | B1 | 12/2002 | Werner |
| 6,716,106 | B2 | 4/2004 | Wang et al. |
| 6,837,830 | B2 | 1/2005 | Eldridge |
| 6,857,992 | B1 | 2/2005 | Kolda et al. |
| 7,060,009 | B2 | 6/2006 | Greenleaf |
| 7,220,219 | B2 | 5/2007 | Papadopoulos et al. |
| 7,942,790 | B2 | 5/2011 | Papadopolous |
| 2002/0055422 | A1 | 5/2002 | Airmet et al. |
| 2004/0053751 | A1 | 3/2004 | Pizolato |
| 2004/0077465 | A1 | 4/2004 | Schmidt |
| 2005/0164843 | A1 | 7/2005 | Papadopoulos |
| 2005/0209064 | A1 | 9/2005 | Peterson et al. |
| 2006/0217237 | A1 | 9/2006 | Rhodes et al. |
| 2007/0060453 | A1 | 3/2007 | Papadopoulos |
| 2009/0264261 | A1 | 10/2009 | Papadopoulos |
| 2011/0218080 | A1 | 8/2011 | Papadopoulos |
| 2011/0287901 | A1 | 11/2011 | Wan |

FOREIGN PATENT DOCUMENTS

| | | | |
|---|---|---|---|
| FR | 23333529 | A1 | 7/1977 |
| FR | 2657024 | A1 | 7/1991 |
| SU | 1319881 | A2 | 6/1987 |
| WO | 9423807 | A1 | 10/1994 |
| WO | WO1994023807 | A1 | 10/1994 |
| WO | 0136055 | A1 | 5/2001 |
| WO | WO2005035072 | A1 | 4/2005 |
| WO | WO2007/033254 | A3 | 11/2007 |

OTHER PUBLICATIONS

Christensen et ai, "Inertial-Force Feedback for the Treadport Locomotion Interface", Presence, vol. 9, No. 1, pp. 1-14 (Feb. 2000).

LIGHT-WEIGHT PORTABLE BICYCLE ROLLERS

RELATED APPLICATIONS

This application is a continuation of PCT international application serial number, PCT/US14/65370, filed Nov. 13, 2014, which is itself a continuation-in-part of U.S. patent application Ser. No. 14/080,016, filed on Nov. 14, 2013, now U.S. Pat. No. 9,295,894, issued on Mar. 29, 2016, which are incorporated by reference as if fully set forth herein.

BACKGROUND

Bicycle rollers are well known devices for supporting a bicycle and permitting a user to mount and ride the bicycle with the rear wheel rotatably supported by a pair of rear rollers and the front wheel rotatably supported by a single front roller. Motion permitting bicycle rollers include the above described device mounted on wheels or some other motion permitting assembly, so that the rollers and bicycle can move slightly forward and rearward during use, limited by a motion-resisting assembly. To provide a realistic riding sensation, the motion-resisting assembly must permit from 5 to 10 cm of forward and rearward movement, gently resisted and urged back to a center point. To achieve this goal, some currently available systems include an outer frame, which provides a stationary track for movement and an anchor point for one or more elastic members ("bungies") which gently resist the movement. This produces a far more realistic sensation of bicycle riding. Also, however, it is virtually impossible to build an easily collapsible assembly, using this basic structure, because of the two frames.

Whether motion permitting or not, currently available bicycle rollers connect the front roller and rear rollers with a pair of structural rails running along the sides of the rollers about 15 cm off the ground, suspending the rollers above the ground and carrying the weight of the cyclist. Accordingly, these rails present a trip hazard to the user mounting or dismounting from a bicycle mounted on the rollers. When a rider loses his balance and must dismount very quickly, these rails present a particular hazard.

With respect to motion permitting rollers, the current designs tend to be somewhat heavier than would be ideally desirable, and are not collapsible, for easy transport.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In a first separate aspect, the present invention may take the form of a bicycle rollers device, having a frame that includes a rear mounting assembly for two rear rollers; a front mounting assembly for a front roller; support elements, for supporting the frame above a surface, upon which the support elements are set to rest; and a central bridge connecting the front drum assembly to the rear drum assembly. Also, two rear rollers are mounted in the rear mounting assembly and a front roller is mounted in the front mounting assembly and defines a roller width. Finally, the central bridge is more narrow than the roller width, thereby permitting a bicycle rider to mount and dismount a bicycle set on the rollers without encountering the central bridge.

In a second separate aspect, the present invention may take the form of a bicycle rollers device, having a frame that includes a rear roller mounting assembly for two rear rollers; a front roller mounting assembly for a front roller; and a central bridge assembly connecting the front mounting assembly to the rear mounting gear. Also, two rear rollers are mounted in the rear mounting assembly, and a front roller is mounted in the front mounting assembly, each of the rollers having an axis of rotation. Finally, a set of wheels, each rotatably mounted on the roller axles, so as to support the rollers above a surface upon which the wheels are set, the wheels permitting forward and rearward motion of the support assembly and all six of the wheels having an axis of rotation co-incident with the roller axes of rotation.

In a third separate aspect, the present invention may take the form of a bicycle rollers device, having a frame that includes a rear roller mounting assembly for two rear rollers; a front roller mounting assembly for a front roller; and a central bridge assembly connecting the front mounting assembly to the rear mounting gear. Also, two rear rollers are mounted in the rear mounting assembly, and a front roller is mounted in the front mounting assembly and a set of wheels are mounted on the roller axles so as to support the rollers above a surface upon which the wheels are set, the wheels permitting forward and rearward motion of the support assembly. Finally, a motion-resisting assembly, includes one of the set of wheels, which is a motion-resisting wheel, having a wheel attachment element displaced from the axis of rotation, a frame attachment element on the frame, and an elastic tension member, which is attached to the frame attachment element and the wheel attachment element, wherein the motion-resisting wheel has a centered position in which the elastic tension member is at its shortest and wherein when the motion-resisting wheel rotates from the centered position the elastic tension member urges it toward its centered position.

In addition to the exemplary aspects and embodiments described above, further aspects and embodiments will become apparent by reference to the drawings and by study of the following detailed descriptions.

Exemplary embodiments are illustrated in referenced drawings. It is intended that the embodiments and figures disclosed herein are to be considered illustrative rather than restrictive.

DETAILED DESCRIPTION

Figure 1:
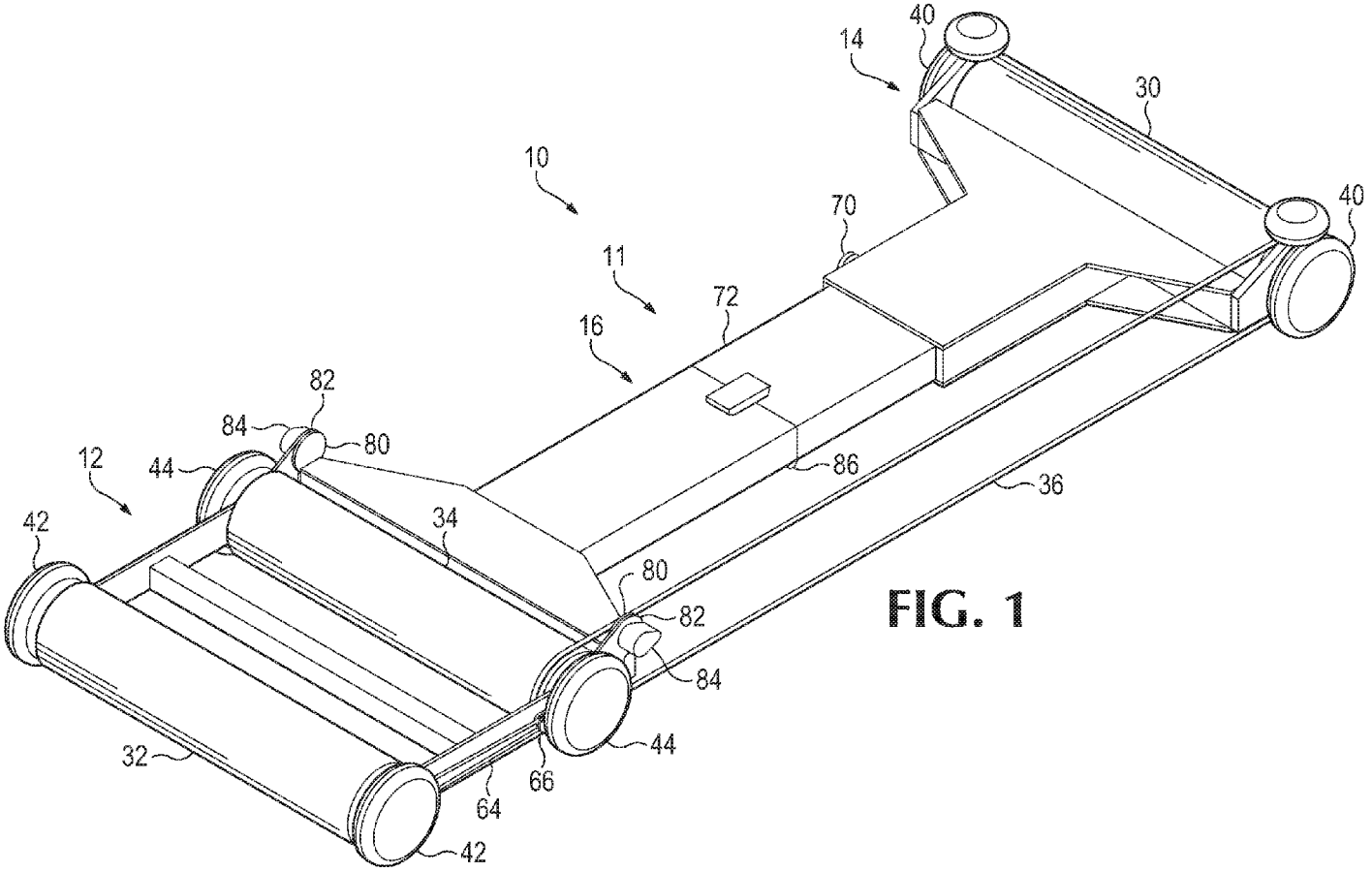
FIG. 1 is a top-side perspective of a bicycle rollers device, according to a preferred embodiment of the present invention.
Figure 2:
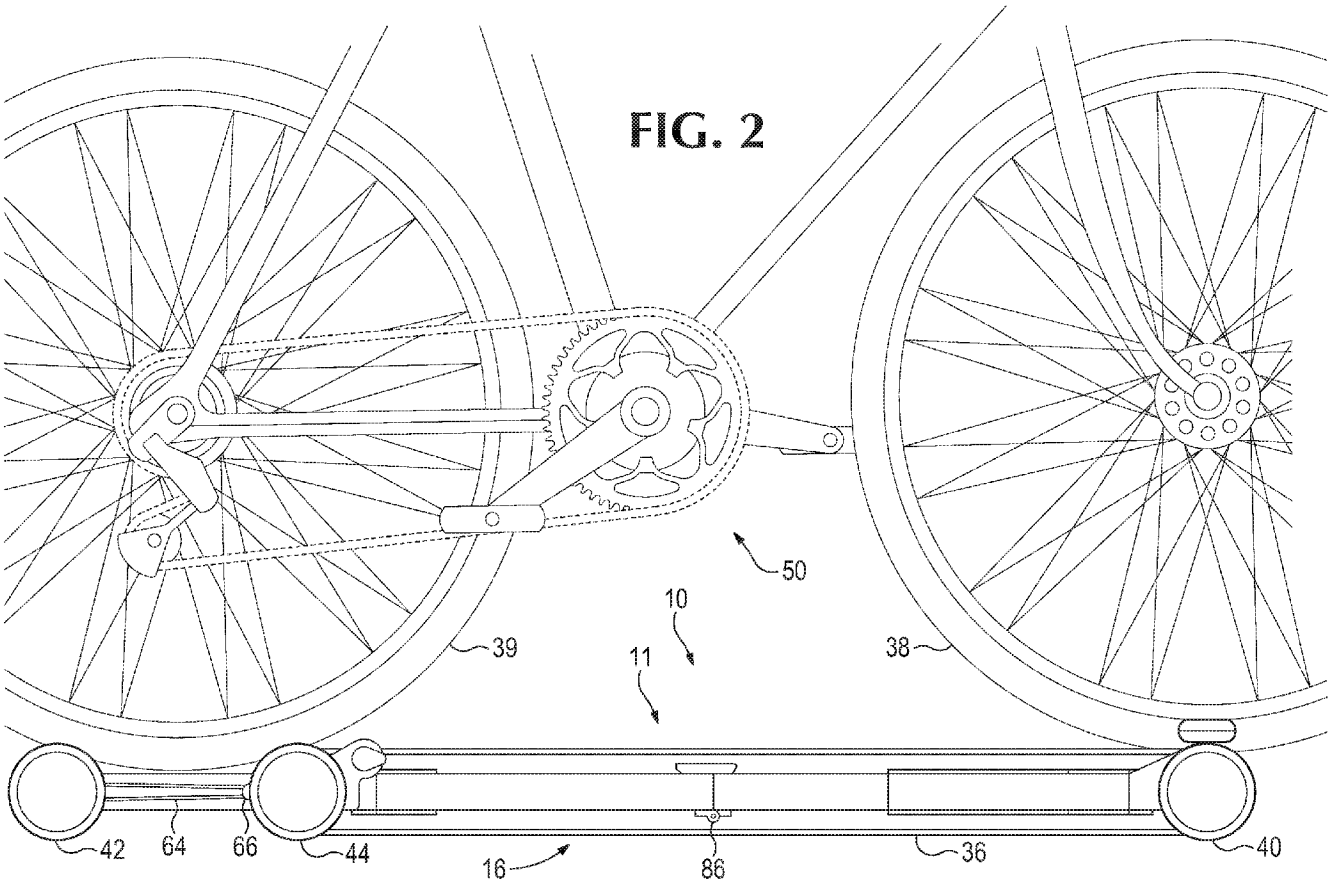
FIG. 2 is a side view of the bicycle rollers device of FIG. 1, showing a bicycle mounted thereto.

Referring to FIGS. 1 and 2, in a preferred embodiment of a bicycle rollers device 10, a frame 11, includes a rear roller mounting assembly 12 and a front roller mounting assembly 14, joined together by a bridge 16. A front roller 30 is rotatably mounted in front assembly 14 and a rearmost roller 32 and forward rear roller 34 are mounted in rear assembly 12. A belt 36 transfers the motion of forward rear roller 34 to front roller 30, so that a front wheel 38 of a bicycle 50 (FIG. 2) rotates when the rear bicycle wheel 39 (FIG. 2) is driven by a rider, as happens when a bicycle is ridden along a road. Front roller 30 also permits steering of front wheel 38, which is necessary for the rider and bicycle to stay upright. Also, the axis of the front wheels 40 are mounted onto front mounting assembly 14, in alignment with the axis of rotation of front roller 30. Also rearmost wheels 42 and forward rear wheels 44 are mounted on rear mounting assembly 12, with the axis of rotation of the rearmost wheels 42 aligned with the axis of rotation of the rearmost roller 32 and the axis of rotation of the forward rear wheels 44 aligned with the axis of rotation of the forward rear roller 34. As a result of this alignment, the rear assembly 12 and front assembly 14 don't have to bear a downward force from a roller, such as roller 30, 32 or 34 at a point not directly supported by a wheel, such as 40, 42 and 44. The transfer of force from a roller to a ground support in other systems required comparatively stronger and therefore heavier elements. In a preferred embodiment the bridge 16 is made of lightweight polymeric material, thereby resulting in a much lighter overall device 10. This is made possible because no vertical load is shifted through bridge 16, from a roller to a support. As shown in FIG. 2, a bicycle may be placed on device 10.

Figure 3:
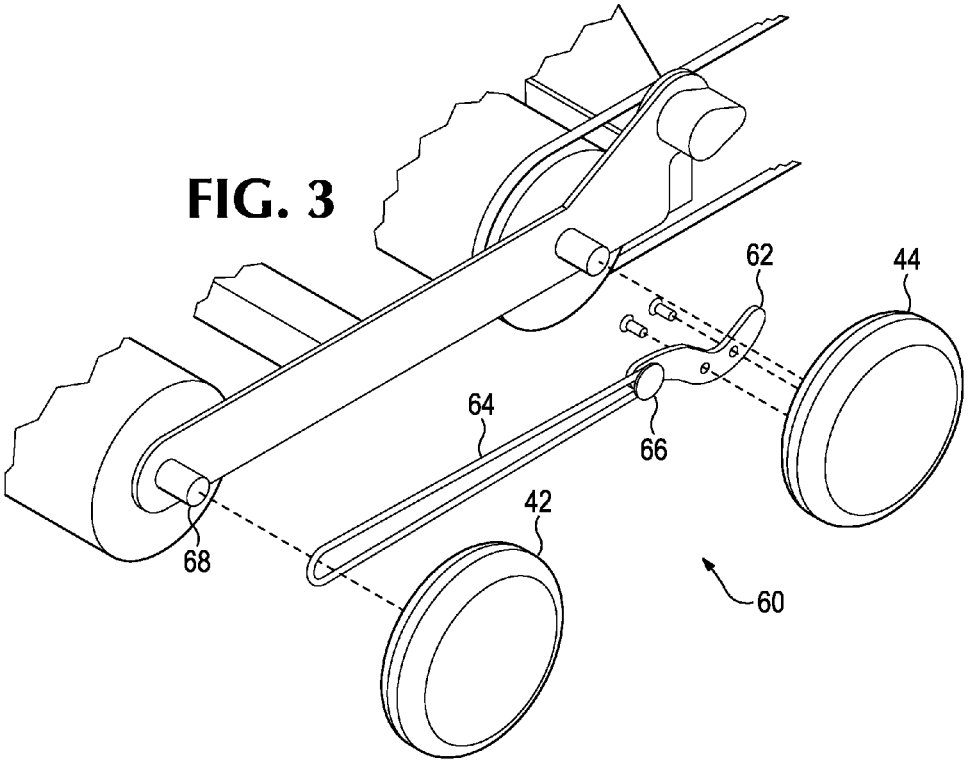
FIG. 3 is an exploded perspective view of a rear portion of the device of FIG. 1, showing a motion-resisting assembly.
Figure 4:
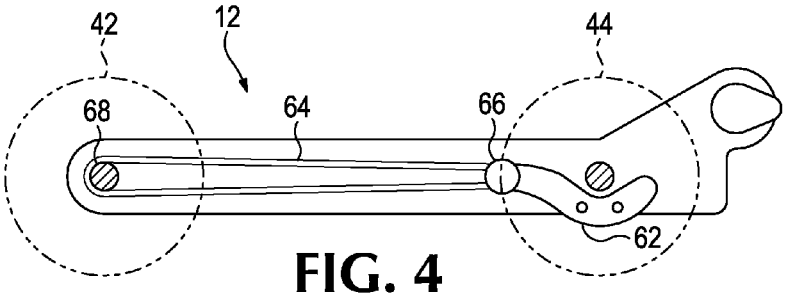
FIG. 4 is a side view of the rear portion of FIG. 3, showing the motion-resisting assembly, at the center of the range of motion.
Figure 5:
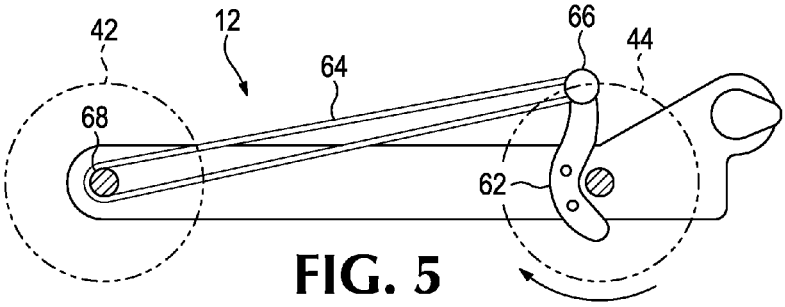
FIG. 5 is the side view of FIG. 4, showing the motion-resisting assembly at an extreme position of its range of motion.

Referring to FIGS. 3-5 a motion-resisting assembly 60, restricts movement of device 10 to a range on the order of ±10 cm, so that device 10 can be placed in a limited space, for example a room, without fear of contacting any of the boundaries of the space, for example walls. A rigid arm 62 is attached, off center, to a wheel 44 and supports a wheel attachment element 66, in the form of a post. Also, rear mounting assembly 12, supports a frame attachment element 68 in the form of a stationary axle, about which one of wheels 42 is rotatably mounted. An elastic tension member 64 in the form of an elastic loop is attached to the wheel attachment element 66 and the frame attachment element 68. Wheel 44 has a centered position (shown in FIGS. 3 and 4), in which tension member 64 is stretched the least possible amount. When wheels 44 is rotated away from this center position (FIG. 5), tension member 64 is stretched further, thereby applying force to attachment element 66 which urges wheel 44 back to its center position. In one embodiment, assembly 60 is mounted on only one side of device 10, in another embodiment an identical assembly 60 is mounted on both sides. Skilled persons will recognize that attachment elements 66 and 68 may take many forms. For example, elements 66 and 68 could both be apertures, with elastic member 64 threaded through both of them and having enlarged ends, to prevent becoming disengaged. Attachment element 68 could be a post that does not serve as an axle to a wheel. Alternatively, it could be a vertically oriented bridge or bracket, through which member 64 is threaded. Tension member 64 is preferably made of polyurethane, which has advantageous elastic properties, so that elastic tension member 64, when made of polyurethane, behaves as a damped spring. In an alternative preferred embodiment, a compression spring is used instead of tension member 64, and is attached to wheel 44 support assembly attachment element, so that at the centered position of wheel 44, the compression spring is at its maximum length.

Figure 8:
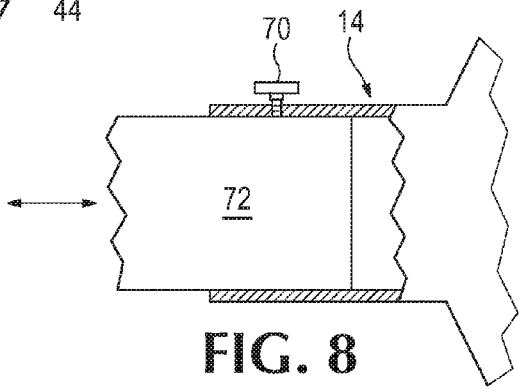
FIG. 8 is a detail view of a telescoping portion of the device of FIG. 1.

Referring to FIGS. 1 and 8 a threaded clamp 70 is mated with a matching hole in assembly 14, so that when post 70 is tightened into hinged central column 72 (which forms a portion of bridge 16), it retains column 72 in relation to assembly 14. When post 70 is loosened away from column 72, column 72 may be adjusted in relationship to assembly 14, thereby permitting the accommodation of different sized bicycles.

Figure 6:
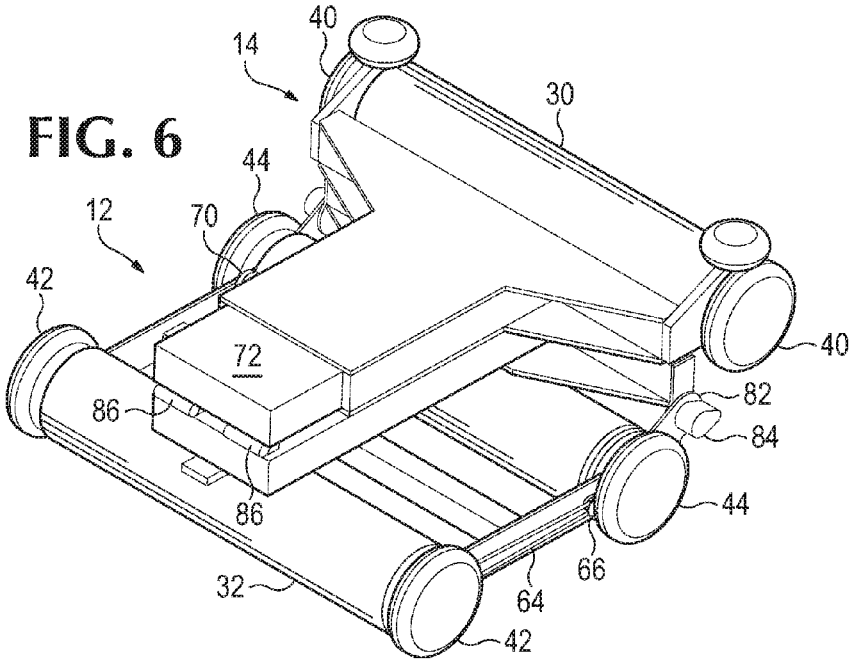
FIG. 6 is a perspective view of the device of FIG. 1, shown in its telescoped in, and folded configuration, for portability.
Figure 7:
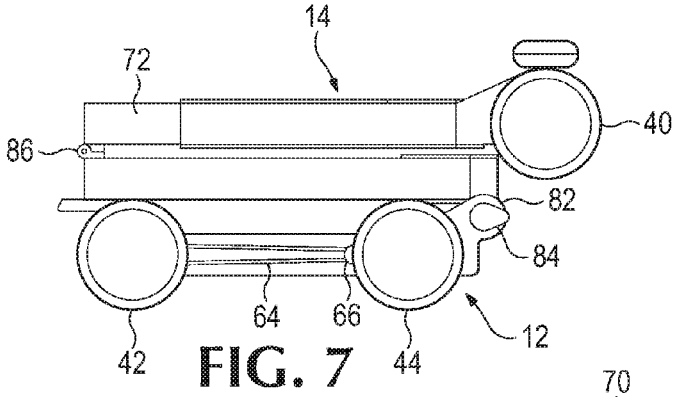
FIG. 7 is a side view of the configuration of FIG. 6.

The folding of device 10 from the configuration shown in FIG. 1, to that shown in FIG. 6 is, in part, made possible by the rotatable attachment of bridge 16 to rear assembly 12. A pair of ears 80 projecting upwardly from the rear of bridge 16 are rotatably mounted to a pair of projections 82. Referring to FIG. 6, bridge 16 and assembly 14 are rotated about projections 82, to cover assembly 12. A pair of locking pins 84 are provided to lock assembly 12 and bridge 16 in this position or in the position shown in FIG. 1. Next assembly 14 is rotated about hinge 86, to arrive at the configuration shown in FIGS. 6 and 7. Elastic loop 64 may be easily disengaged from post 66 to permit device 10 to be wheeled to a desired location, on wheels 42 and 44.

Central column 72 is made of rectangular polyvinyl tube 14 cm×3.8 cm in transverse dimension, having wall thickness of 2.3 mm. The remainder of the frame 11 is made of either aluminum or steel. In one embodiment the entire device 10 has a mass of less than 8 kg. In an alternative embodiment device 10 has a mass of less than 9 kg. And in yet another alternative, device 10 has a mass of less than 10 kg.

Figure 9:
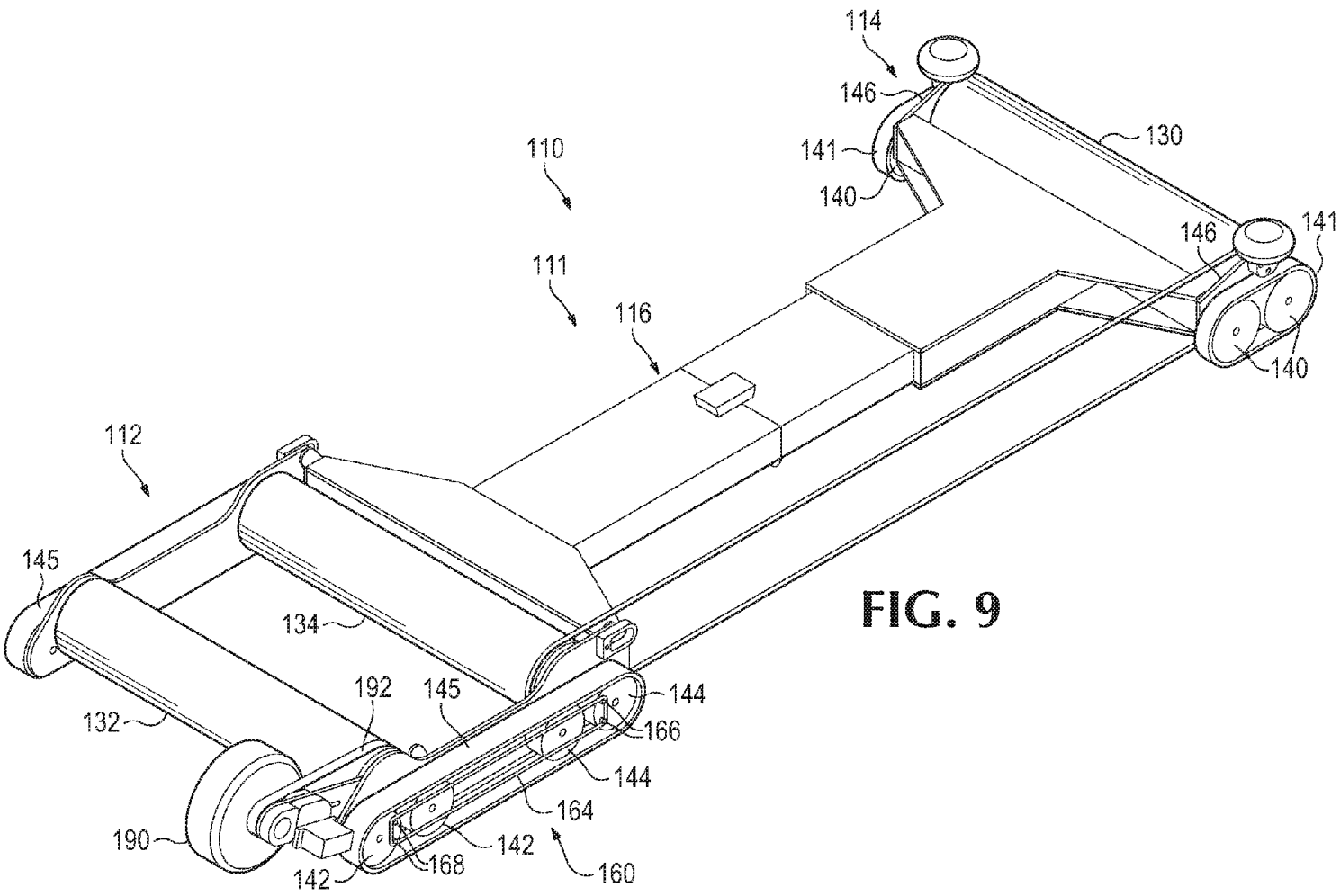
FIG. 9 is an isometric view of a bicycle rollers device according to an alternative preferred embodiment of the present invention.
Figure 10:
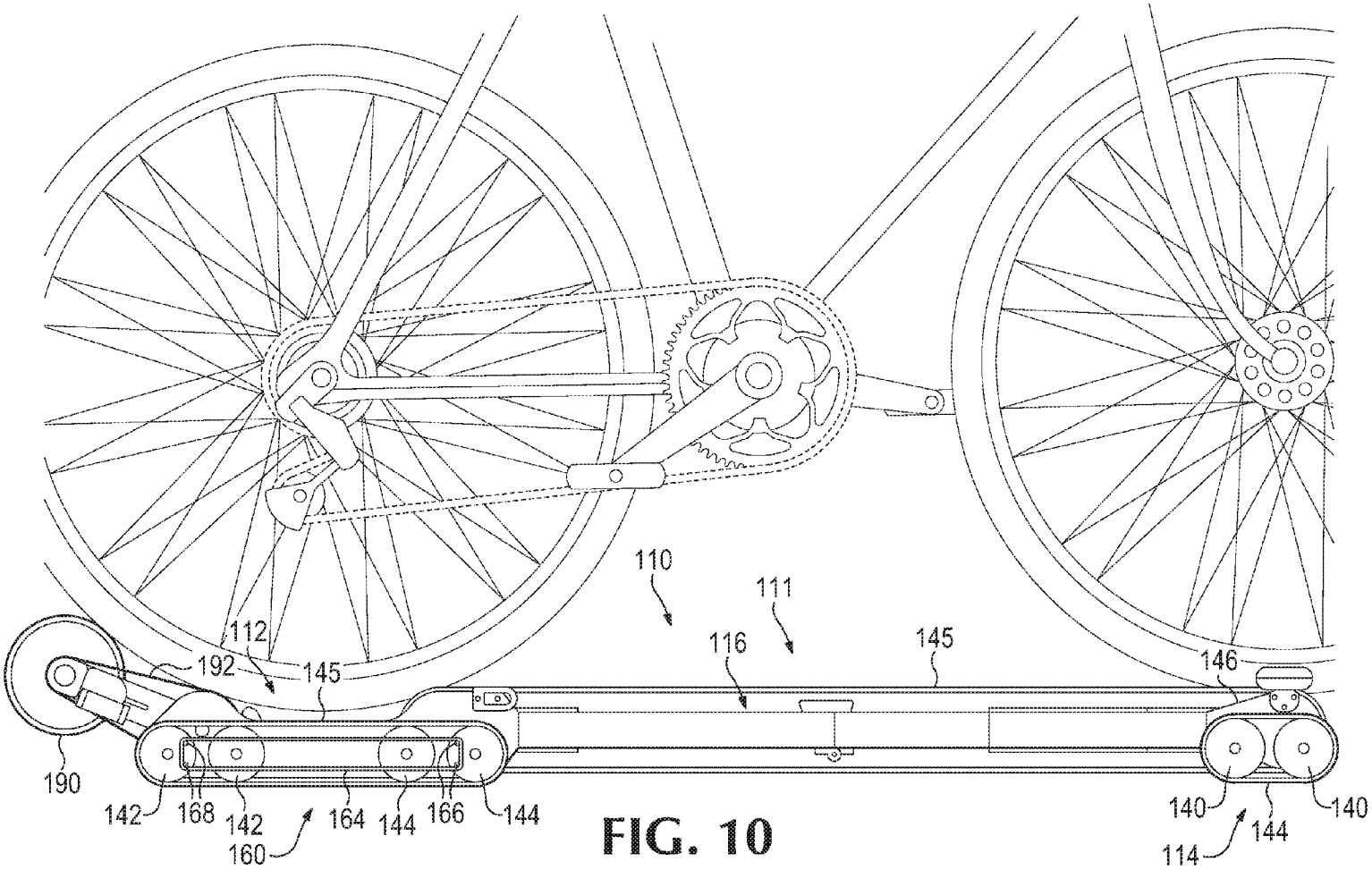
FIG. 10 is a side view of the device shown in claim 9, supporting a bicycle.

Referring to FIGS. 9 and 10 (in which all like elements to the previously described embodiment) are denoted by the previous reference number plus 100), an alternative preferred embodiment of a bicycle rollers device 110, includes a pair front wheels 140, joined by a belt or track 141, on either transverse side. Similarly, in the rear, there is a rearward and forward pair of closely spaced wheels 142 and 144, on either side, with both pairs 142 and 144 joined by a track 145, and being jointly mounted on a plate 146, which is, in turn, mounted on the frame 111. Wheels 140 are spaced evenly about the rotational axis of front roller 130, while wheels 142 and 144 are similarly spaced evenly about the rotational axes of rear rollers 132 and 134, respectively. As a consequence of this arrangement, the weight of rear and front roller mounting assemblies, 112 and 114 respectively, and any weight born by these assemblies, by holding a bicycle and a rider for example, is born directly by wheels 140, 142 and 144. Accordingly bridge 116 is not vertically stressed by weight applied to the rollers 130, 142 and 144, and may be made of weaker and lighter weight materials, than would be the case if this weight did vertically stress bridge 116, by for example, bearing a cantilevered load.

Similar to the prior shown embodiment, device 110 includes a motion resisting assembly 160, comprising an elastomeric loop 164, looped around two posts 166 on the forward wheel of the forward pair of wheels 144, and two posts 168 on the rearward wheel of the rearward pair of wheels 142. Because posts 166 are placed in a rearward location on the more forward wheel 144, and posts 168 are placed in a forward location on the more rearward wheel 144, the effect of wheel rotation is opposite on posts 168, relative to posts 166. When device 110 moves forward, the topmost of posts 166 will move forward, whereas the topmost of posts 168 will move rearward, thereby stretching loop 164, which has the effect of urging device 110 to move in a rearward direction, and resisting further forward movement. When device 110 moves rearward, the reverse process occurs, and device 110 is urged forward, with further rearward motion resisted.

Belts 141 and 145 cause the wheels on both sides of device 110 to turn in greater unison than they otherwise would. This is particularly important for the rear belt 145 because the rear wheels 142 and 144 host the motion resisting assembly 160. Varying wheel rotation between the sides would have the potential to limit the effectiveness of assembly 160, thereby permitting device 110 to creep forward or rearward an unacceptable distance. Also, belts 141 and 145 have less of a tendency to be stopped by a small item, such as a grain of sand or a pebble, that might be on the floor of a garage, where device 110 might be used.

A flywheel 190 is operatively connected to rearmost roller 132 by means of a ¼ inch belt 192. This flywheel acts to mimic the effect of inertia and momentum for a rider having his bicycle on assembly 110.

In an embodiment, a bicycle rollers device has a front and a back and comprising: a frame including, a rear mounting assembly for two rear rollers, a front mounting assembly for a front roller, support elements, for supporting the frame above a surface, upon which the support elements are set to rest; and a central bridge connecting the front mounting assembly to the rear mounting assembly. Also, two rear rollers are mounted in the rear mounting assembly; a front roller is mounted in the front mounting assembly and defining a roller width; and the central bridge is more narrow than the roller width, thereby permitting a bicycle rider to mount and dismount a bicycle set on the rollers without encountering the central bridge. In this embodiment the support elements are wheels, permitting forward and rearward movement. Further, the device may be such that once placed on a surface it has a central position and further includes a motion resisting assembly that urges the device back to the central position. Also, the device may have a belt between one of the rear rollers and the front roller, on one side of said device, leaving the other side clear for mounting and dismounting. In addition, the central bridge may be made of two pieces that telescope together and include a mechanism for locking the two pieces into place. In addition, the central bridge may be made of polymeric tubing, which may be, more specifically, polyvinyl tubing.

In a further embodiment, a bicycle rollers device has a front and a back, a longitudinal dimension, and includes a frame including a rear roller mounting assembly for two rear rollers, a front roller mounting assembly for a front roller; and a central bridge assembly connecting the front mounting assembly to the rear mounting gear. Two rear rollers are mounted in the rear mounting assembly, and a front roller mounted in the front mounting assembly, each the roller having an axis of rotation. A first support assembly is co-located longitudinally with the rear roller mounting assembly and is able to support the rear roller mounting assembly above an upwardly facing surface. Further, a second support assembly is co-located longitudinally with the front roller mounting assembly and able to support the front roller mounting assembly above an upwardly facing surface. Finally, when the device is in use the first and second support assemblies support the roller mounting assemblies and the weight the roller mounting assemblies are supporting, above an upwardly facing surface, leaving the central bridge substantially free of vertical structural stress. In this embodiment, the second support assembly may comprise a single wheel mounted on an axle attached to the frame, and substantially vertically aligned to the axis of the front roller. Also, the second support assembly may comprise two wheels, mounted on axles supported by the frame, and wherein the two wheels are substantially centered about the axis of the front roller. Further, the axles may be mounted on the frame by being mounted on a support plate, which is mounted on the frame. In addition, the bridge may be made of light-weight polymeric material In a yet further embodiment a bicycle rollers device, has a front and a back and comprises: a frame that includes a rear roller mounting assembly for two rear rollers, a front roller mounting assembly for a front roller; and a central bridge assembly connecting the front mounting assembly to the rear mounting gear. Also, two rear rollers are mounted in the rear roller mounting assembly, and a front roller is mounted in the front roller mounting assembly. A set of wheels are mounted on the frame so as to support the rollers above a surface upon which the wheels are set, the wheels permitting forward and rearward motion of the support assembly. Also included is a motion-resisting assembly, wherein a first one of the set of wheels is a motion-resisting wheel, having an axis of rotation and a first attachment element displaced from the axis of rotation; a second attachment element on the bicycle rollers device, longitudinally displaced from the first attachment element; and an elastic tension member, attached to the first attachment element and the second attachment element, wherein the motion-resisting wheel has a centered position in which the elastic tension member is at its shortest. Further, wherein when the motion-resisting wheel rotates from the centered position the elastic tension member urges it toward its centered position. In this embodiment, the first attachment element may be a post attached to the motion-resisting wheel, and the elastic tension member may be an elastic loop, that is looped over the post. Further, the post may terminate in a knob that retains the elastic member on the post.

Also, in the yet further embodiment, the motion-resisting wheel may have a circumference and the post may be attached to the wheel by way of a rigid element attached to the wheel, so that the post protrudes past the wheel circumference. In addition, the second attachment element may be a stationary axle for one of the wheels. In addition, the second attachment element may be on a second one of the set of wheels, and wherein the second attachment element is positioned so that as the first attachment element moves forward, with device movement and attendant wheel rotation, the second attachment element will move backward, thereby stretching the elastic tension member, which urges the first one and the second one of the set of wheels, to a centered position. In addition, the elements of the motion resisting assembly may be present on both sides of the device, for laterally balanced motion resistance. In addition, the device may further be divided into segments that are connected together by hinges, so that the device can be folded into a compact state, and wherein the motion-resisting assembly is positioned on a single one of the segments (which may be the rear roller mounting assembly), so that the device can be folded without releasing tension on the elastic tension member. In addition, the elastic tension member may be made of polyurethane. Finally, the elastic tension member may act as a damped spring.

While a number of exemplary aspects and embodiments have been discussed above, those possessed of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A bicycle rollers device having a front and a back and comprising:

(a) a frame including:

(i) a rear mounting assembly for two rear rollers;

(ii) a front mounting assembly for a front roller;

(iii) wheels, rotatably attached to said frame, for supporting said frame above a surface, upon which said wheels are set to rest; and (iv) a central bridge connecting said front mounting assembly to said rear mounting assembly;

(b) two rear rollers mounted in said rear mounting assembly;

(c) a single front roller mounted in said front mounting assembly and defining a roller width; and (d) said wheels being adjacent to each roller, on either end of each roller, and said central bridge being more narrow than said roller width, thereby permitting a bicycle rider to mount and dismount a bicycle set on said rollers without encountering said central bridge.

2. The device of claim 1, wherein once said wheels are placed on a surface said device has a central position on said surface and further including a motion resisting assembly that is configured to urge said device back to said central position.

3. The device of claim 1, having a belt between one of said rear rollers and said front roller, on one side of said device, leaving another side of said device clear for mounting and dismounting.

4. The device of claim 1, wherein said central bridge is made of two pieces that telescope together and including a mechanism for locking said two pieces into place.

5. The device of claim 1, wherein said central bridge is made of polymeric tubing.

6. The device of claim 5, wherein said polymeric tubing is more specifically polyvinyl tubing.

7. A bicycle rollers device, having a front and a back, a longitudinal dimension, and comprising:

(a) a frame including:

(i) a rear roller mounting assembly for two rear rollers;

(ii) a front roller mounting assembly for a front roller; and (iii) a central bridge assembly connecting said front roller mounting assembly to said rear roller mounting assembly;

(b) two rear rollers mounted in said rear roller mounting assembly, and a front roller mounted in said front roller mounting assembly, each of said front and rear rollers having an axis of rotation;

(c) a first wheeled support assembly, including rotatably mounted wheels, co-located longitudinally with said rear roller mounting assembly and able to support said rear roller mounting assembly above an upwardly facing surface, while permitting forward and backward movement over said surface;

(d) a second wheeled support assembly, including rotatably mounted wheels, co-located longitudinally with said front roller mounting assembly and able to support said front roller mounting assembly above the upwardly facing surface, while permitting forward and backward movement over said surface; and (e) wherein when said device is in use said first and second wheeled support assemblies evenly support said front and rear roller mounting assemblies and weight said front and rear roller mounting assemblies are supporting, above the upwardly facing surface, leaving said central bridge assembly substantially free of vertical structural stress.

8. The device of claim 7, wherein said second wheeled support assembly comprises a single wheel, on either transverse side of said device, mounted on an axle attached to said frame, and aligned with said axis of said front roller.

9. The device of claim 7, wherein said second wheeled support assembly comprises two wheels, on either transverse side of said device, mounted on axles supported by said frame, and wherein said two wheels are centered about said axis of said front roller.

10. The device of claim 9, wherein said axles are mounted on said frame by being mounted on a support plate, which is mounted on said frame.

11. The device of claim 7, wherein said central bridge assembly is made of light-weight polymeric material.

12. A bicycle rollers device, having a front and a back and comprising:

(a) a frame including:

i. a rear roller mounting assembly for two rear rollers;

ii. a front roller mounting assembly for a front roller; and iii. a central bridge assembly connecting said front roller mounting assembly to said rear roller mounting assembly;

(b) two rear rollers mounted in said rear roller mounting assembly, and a front roller mounted in said front roller mounting assembly;

(c) a set of wheels mounted on said frame so as to support said front and rear rollers above a surface upon which said wheels are set, said wheels permitting forward and rearward motion of said frame; and (d) a motion-resisting assembly, including:

i. wherein a first wheel of said set of wheels is a motion-resisting wheel, having an axis of rotation and a first attachment element displaced from said axis of rotation;

ii. a second attachment element on said bicycle rollers device, longitudinally displaced from said first attachment element; and iii. an elastic tension member, attached to said first attachment element and said second attachment element, wherein said motion-resisting wheel has a centered position in which said elastic tension member is at its shortest length and wherein when said motion-resisting wheel rotates from said centered position said elastic tension member urges said motion-resisting wheel toward its centered position.

13. The device of claim 12, wherein said first attachment element is a post attached to said motion-resisting wheel, and said elastic tension member is an elastic loop, that is looped over said post.

14. The device of claim 13, wherein said post terminates in a knob that retains said elastic tension member on said post.

15. The device of claim 13, wherein said motion-resisting wheel has a circumference and said post is attached to said motion-resisting wheel by way of a rigid element attached to said motion-resisting wheel, so that said post protrudes past said wheel circumference.

16. The device of claim 12, wherein said second attachment element is a stationary axle for one of said set of wheels.

17. The device of claim 12, wherein said second attachment element is on a second wheel of said set of wheels, and wherein said second attachment element is positioned so that as said first attachment element moves forward, with device movement and attendant wheel rotation, said second attachment element will move backward, thereby stretching said elastic tension member, which urges said first wheel and said second wheel of said set of wheels, to a centered position.

18. The device of claim 12, wherein said motion-resisting assembly includes the elements of paragraphs (d) (i) through (d) (iii) on both sides of said device, to provide laterally balanced motion resistance.

19. The device of claim 12, further being divided into segments that are connected together by hinges, so that said device can be folded into a compact state, and wherein said motion-resisting assembly is positioned on a single one of said segments, so that said device can be folded without releasing tension on said elastic tension member.

20. The device of claim 19, wherein said motion-resisting assembly is positioned on said rear roller mounting assembly, which is hinged to said central bridge assembly.

21. The device of claim 12, wherein said elastic tension member is made of polyurethane.

22. The device of claim 12, wherein said elastic tension member acts as a damped spring.

* * * * *